United States Patent [19]

Scott et al.

[11] 4,014,062

[45] Mar. 29, 1977

[54] THREAD CLEANER WITH ROTATABLE AND ADJUSTABLY SUPPORTED BRUSHES

[76] Inventors: Thomas W. Scott, 116 Maplewood Drive, Lafayette, La. 70501; Walter J. Roy, 122 W. Henry, Rayne, La. 70578

[22] Filed: Jan. 6, 1975 (Under Rule 47)

[21] Appl. No.: 538,867

[52] U.S. Cl. ..... 15/104.04; 15/76

[51] Int. Cl.[2] ..... B08B 9/02

[58] Field of Search ..... 15/56, 75, 76, 88, 104.03, 15/104.04

[56] References Cited

UNITED STATES PATENTS

| | | | |
|---|---|---|---|
| 1,502,641 | 7/1924 | Dahl et al. | 15/75 |
| 1,837,389 | 12/1931 | Albany | 15/56 |
| 2,024,812 | 12/1935 | Bachelis | 15/75 |
| 2,305,079 | 12/1942 | Heldenbrand | 15/104.04 |
| 2,635,393 | 4/1953 | Barth | 15/104.04 X |

FOREIGN PATENTS OR APPLICATIONS

| | | | |
|---|---|---|---|
| 831,797 | 1/1970 | Canada | 15/104.03 |
| 622,143 | 11/1935 | Germany | 15/76 |

*Primary Examiner*—Edward L. Roberts
*Attorney, Agent, or Firm*—Vinson, Elkins, Searls, Connally & Smith

[57] ABSTRACT

A thread cleaner for cleaning the pin end of a pipe or tubular member includes a housing with radially adjustable, rotatably mounted brush means therein for engaging the pin end of the pipe or tubular member to clean the threads on the pipe. Power means are adapted to be mounted on the housing for rotating the adjustably mounted brushes with conduit means for injecting solvent or cleaning fluid into the housing as the threads are cleaned and thereafter discharging the solvent or cleaning fluid from the housing.

4 Claims, 3 Drawing Figures fig.1
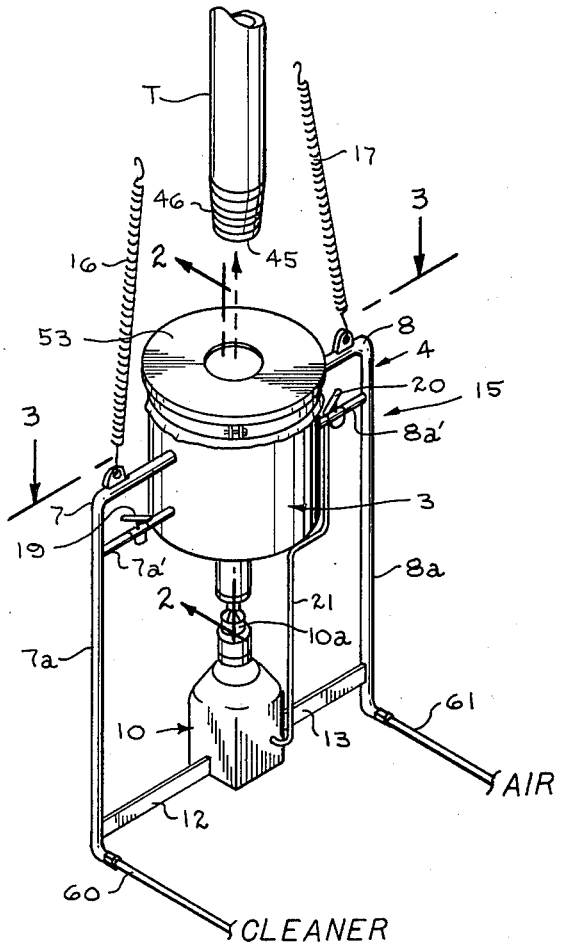
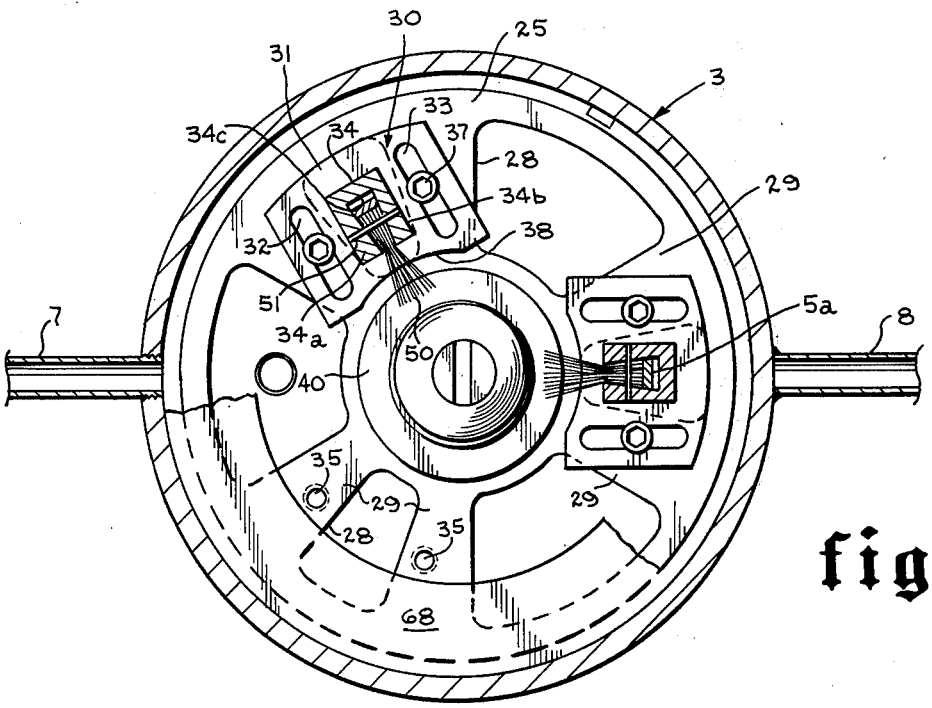
fig.3

THREAD CLEANER WITH ROTATABLE AND ADJUSTABLY SUPPORTED BRUSHES

SUMMARY OF THE INVENTION

The closest prior art with which applicant is familiar is the following U.S. Pat. Nos.: A. P. Heldenbrand, 2,305,079; J. J. Harrigan, 2,682,068; G. Medovick, 2,858,555; E. M. Dunham, 2,960,706; A. E. Betzel, Sr., 3,050,759; R. K. Mills, 3,076,988; C. V. Stevenson, 3,116,811; R. L. Hobbs, 3,188,674; J. C. McCartney 3,436,783; D. J. Schmidt, 3,477,081; R. L. Ford, 3,495,288; and Kratt, 3,641,608.

The present invention has advantages over the above references in that it provides an arrangement which may be readily manipulated and operated to clean the thread ends of a tubular member, particularly the pin end of a threaded pipe or tubular member.

Another object of the invention is to provide a thread cleaner for the pin end of tubular members which includes adjustably mounted brushes rotatably carried in a housing so that the thread cleaner can be adjusted to accommodate pipe ends of different diameters.

Another object of the present invention is to provide a housing having a frame carried thereby to enable the thread cleaner to be supported and manipulated on a rig, such thread cleaner including rotatably mounted and radially adjustable brushes supported in the housing for cleaning the pin end of a pipe.

Another object of the present invention is to provide a housing having a frame carried thereby to enable the thread cleaner to be supported and manipulated on a rig floor, such thread cleaner including rotatably mounted and radially adjustable brushes supported in the housing for cleaning the pin end of a pipe, which frame includes conduit means with valve means therein for controlling the flow of a cleaning fluid to the interior of the housing and a fluid for actuating a motor means to rotate the rotatably mounted, radially adjustably supported brushes in the housing.

Other objects and advantages of the present invention will become more radily apparent from a consideration of the following description and drawings.

BRIEF DESCRIPTION OF THE DRAWINGS

FIG. 1 is an isometric view illustrating a form of the present invention with a tubular member positioned thereabove ready to be received in the thread cleaner for cleaning the threads on the tubular members;

FIG. 3 is a sectional view on the line 3—3 of FIG. 1 illustrating further structural details of the thread cleaner of the present invention.

DESCRIPTION OF THE PREFERRED EMBODIMENT

Figure 2:
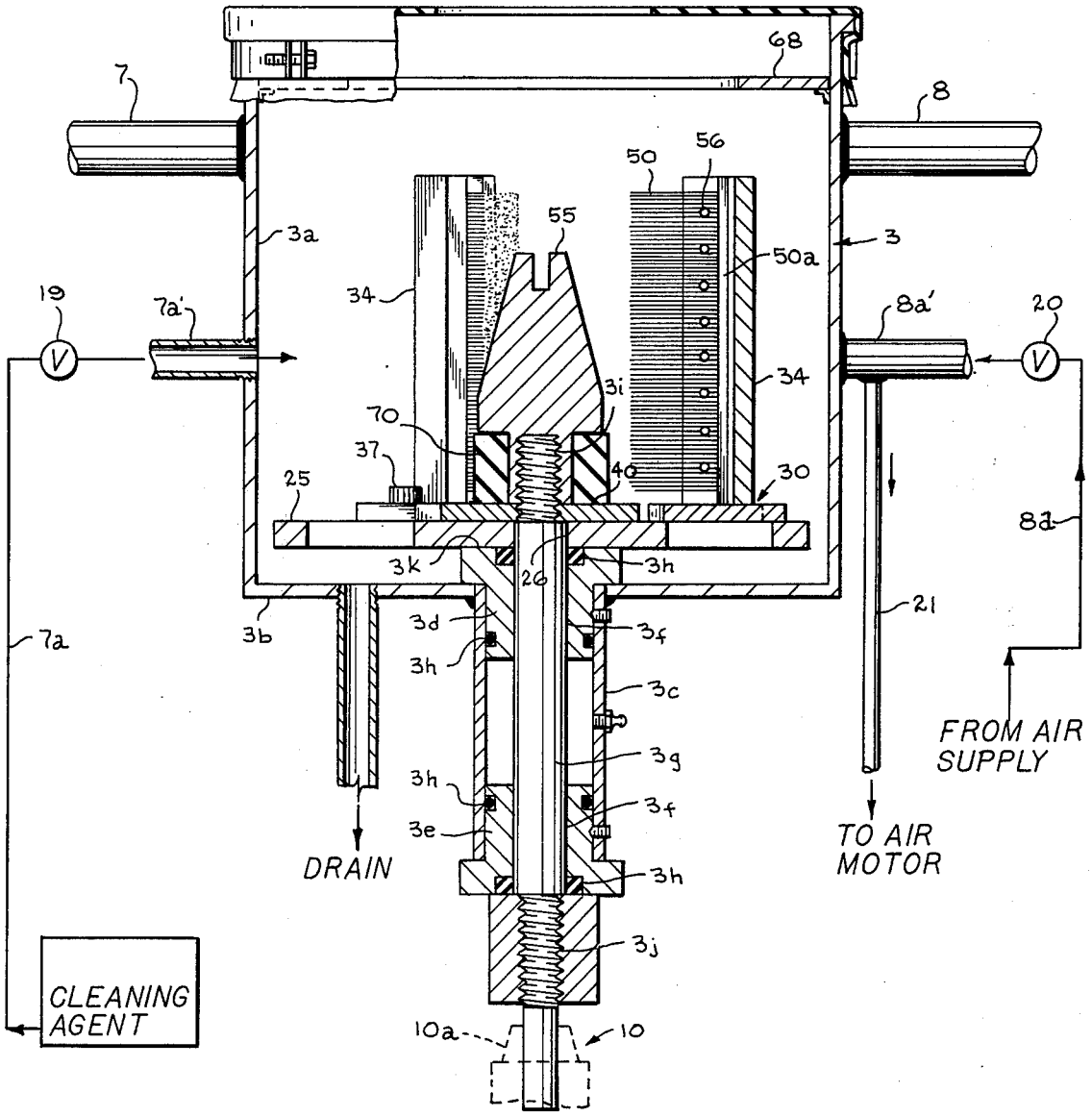
FIG. 2 is a sectional view on the line 2—2 of FIG. 1 illustrating further details of the present invention.

Attention is first directed to FIG. 1 of the drawings wherein the invention is referred to generally by the reference numeral 15. A housing referred to generally at 3 is illustrated as being cylindrical in configuration and is connected to a frame referred to generally at 4. Such frame includes members 7 and 8 extending generally radially from the housing 3 with a portion 7*a* and 8*a* respectively of such member extending generally longitudinally parallel to the longitudinal axis of the housing 3 as shown in the drawings. The portions 7*a* and 8*a* are hollow and provide fluid conduits for receiving a cleaner or solvent through the portion 7*a* and a fluid pressure medium through the portion 8*a*, respectively, for operation of the motor means 10 for rotation of the rotatably mounted adjustably supported brushes within the housing 3 as will be described.

Additional bracket members 12 and 13 extend from the portions 7*a* and 8*a* respectively and are connected to the motor as shown in the drawings to support the motor 10 adjacent the housing 3.

The frame 4 provides a means for supporting the thread cleaner 15 in position when it is to be used on a rig floor, such supporting means including resilient means, such as springs 16 and 17 which extend upwardly and are joined together with cable means (not shown) which cable means is secured to a portion of the drilling rig on which the device is employed.

Extensions 7*a'* and 8*a'* extend from the tubular, generally longitudinally extending portions 7*a* and 8*a* and include valve means 19 and 20 for controlling, respectively, the flow of solvent to the housing 3 and for controlling the flow of fluid pressure medium to the air motor 10 through the conduit 21 which conduit is connected to the extension 8*a'* downstream of the valve 20 and to the motor 10 as shown in the drawings.

In FIG. 2 the cylindrical housing 3 is shown in cross section and includes the annular wall 3*a* and the bottom 3*b*. Secured to the bottom 3*b* is the tubular extension 3*c* which has received in each end thereof bearing 3*d* and 3*e*. The bearing means 3*d* and 3*e* each include an annular opening 3f for receiving the rotatable shaft 3*g* therethrough. The bearing means 3*d* and 3e also each include suitable seals as illustrated at 3*h* for sealably engaging with the rotatable shaft 3*g* and the interior of the tubular extension 3*c* as shown to inhibit linkage therefrom.

The upper and lower ends of the rotatable shaft 3*g* are threaded as shown at 3*i* and 3*j* respectively to aid in positioning the shaft and bearing means relative to the tubular extension 3*c* and in position on the housing 3 as will be described.

A plate or disc 25 is carried within the housing 3 and is supported on the upper end 3*k* of the bearing 3*d* as shown in FIG. 2 which plate is provided with an opening 26 for receiving the shaft 3*g* therethrough as shown. The plate or disc 25 may have a plurality of openings 28 circumferentially spaced therein to lighten the plate but which is provided with segments 29 at circumferentially spaced positions for receiving the adjustable brush support means referred to generally at 30.

The brush support means 30 include segments or plate members 31 having spaced slots 32 and 33 with brush support means 34 secured to the segment 29 between the slots 32, 33 and which brush support means extends generally vertically from each of the plate members 31 as shown in FIGS. 2 and 3 of the drawings.

The segments 29 in plate or disc 25 are provided with threaded openings 35 for receiving securing means such as the Allen screws 37 which extend through the slots 32 and 33 to enable the plate members or segments 31 to be adjusted radially relative to the housing 3 and disc 25 on which they are mounted and secured in such adjusted position. If desired the inner edge of the plate members may be of arcuate configuration as illustrated at 38, and the plate members 31 surround a plate bushing or bearing plate 40 mounted on the shaft 3*g* by any suitable means such as by threadedly engaging the threaded end 3*i* of the shaft 3*g* as shown in FIG. 2 of the drawings.

The bearing plate 40 is generally centrally disposed of the housing 3 as shown in FIG. 3 and is of suitable width and material so as to receive the end 45 of the tubular member T when it is inserted into the housing 3 for cleaning the threads 46 thereon by the brushes 50 mounted on the support means 34 as shown in FIGS. 2 and 3 of the drawings.

The bushing 40 is retained in place by the member 55 which is generally cone shaped as shown and projects from the disc 25 between and in the same direction as the brushes 50 for engaging within the end of the tubular member T to aid in supporting and positioning the tubular member T within the housing 3 as the brushes 50 are rotated for cleaning the threads 46 thereon.

An annular rubber or elastomer member 70 is positioned between member 55 and plate 40 as shown in the drawings. It is slightly larger in diameter than the member 55 and engages the inner end of tubular member T when the member T is positioned in the thread cleaner. Thus if the pipe T is coated on the interior damage thereto is reduced if not eliminated. The member 55 is threaded to engage the threaded end 3*i* of shaft 3*g* and it serves to retain plate or disc 25, elastomer member 70, bearing plate 40 and the segments 30 carried on disc 25 in position in the housing 3. Bearing nut 3*e* is threaded to end 3*j* of shaft 3*g* and thus the assembly is sealably and rotatably supported in housing 3.

It will be noted that two plate members 31 are shown, and provision is made on plate 25 for a third; however any desired number of plate members 31 may be provided to support a desired number of generally vertically extending radially adjustable brushes 50.

In operation of the present invention, a solvent or cleaner from any suitable source is pumped through a flexible conduit 60 into the tubular portion 7*a*. Similarly a compressed medium such as air is conducted through the conduit 61 from a source not shown and to the portion 8*a*. When it is desired to actuate the thread cleaner of the present invention, the tubular member T is inserted in the opening 52 formed in the closure of cap 53 on the housing 3. Such closure or cap may be of any suitable material such as plastic or the like to avoid damage to the tubular member T. When the tubular member T is inserted in the opening 52, its end 45 telescopes over member 55 and abuts against the bushing 40. The plate members 31 will have been previously adjusted radially relative to the plate 25 so as to position the brushes 50 in a proper position radially relative to the threads 46 on tubular member T for engagement therewith.

The valves 19 and 20 are provided with triggers so that when portions 7*a*, 7*a'* and 8*a*, and 8*a'* are manually grasped, the triggers may be depressed to actuate, or open valves 19 and 20. By actuating the valves 19 and 20 solvent may be simultaneously conducted from the conduit 60 through the tubular member 7*a* and extension 7*a'* into the interior of the housing as represented by the arrow at 66 in FIG. 2. The compressed air or other fluid medium is conducted from the flexible conduit 61 through the tubular extensions 8*a* and 8*a'* and then through the conduit 21 to the motor 10 which may be an air motor or the like. When this occurs, rotation is imparted to the shaft 10*a* of the mottor and to the shaft 3*g* connected therewith. Rotation of the shaft 3*g* causes the plate 25 and the brushes 50 to rotate and clean the threads 46.

Normally, rotation of the brushes 50 is for a relatively short time such as from fifteen seconds to one minute to clean the threads 46 while solvent is being discharged under pressure into the housing through the conduit 7*a* to further aid in cleaning the threads. The valves 19 and 20 are then released which close off flow of the solvent and compressed air whereupon the thread cleaner 15 is withdrawn from the end of the tubular member T.

The brushes 50 are removably carried in the generally vertically extending brush support 34 by suitable means such as the pin means 51 which engage in openings 56 in the sides 34*a* and 34*b* of the vertically extending support 34. The sides 34*a* and 34*b* are separated by the dove tailed shaped groove 34*c* which extends longitudinally of the support 34 as shown in FIGS. 2 and 3 of the drawings and receives the brushes 50 which are mounted on a carrier plate 50*a* extending longitudinally thereof. Thus, the brushes 50 may be replaced merely by removing the pin 51 and withdrawing them from the slot 34*c* whereupon new brushes may be inserted therein and pinned in place by the pin or key 51.

An additional annular plate 68 is mounted on the interior of the housing above the vertically extending brush support means 34, to act as a further guide and support for the pipe during cleaning operations.

A drain 68 in the bottom 36 of the housing 3 is provided for discharge of the solvent, and a flexible hose may be connected to the drain 68 to return the solvent or cleaning agent to its source for reuse.

It can be appreciated that the present invention may be used to clean pipe at any location such as on the racks, and the description as to cleaning in a rig floor is merely for purposes of explanation.

The foregoing disclosure and description of the invention are illustrative and explanatory thereof, and various changes in the size, shape, and materials as well as in the details of the illustrated construction may be made without departing from the spirit of the invention.

What is claimed is:

1. A cleaner for cleaning the threads on a pipe end comprising:

a housing having an open end;

a frame extending from each side of said housing;

resilient means connected to said frame for resiliently and movably supporting said housing in an elevated position;

a disc rotatably supported in said housing opposite said open end of said housing;

brush means for engaging the threaded pipe end;

adjustable means supporting said brush means on said disc for lateral adjustment thereof;

a member projecting from said disk adjacent said brush means for engaging within the end of a pipe to support it while the threaded pipe end is cleaned;

a cover for said housing open end having an opening therein for receiving the threaded pipe end therethrough to be engaged by said brushes for cleaning thereof; and means for rotating said disc and brushes thereon for cleaning the threaded pipe end in said housing.

2. An apparatus for receiving the external threads on the end of elongated, heavy, tubular member and for cleaning such threads, including:

a housing having an opening therein for receiving the threaded end of the tubular member;

a shaft mounted for rotation in the housing;

motor means associated with the shaft for rotating such shaft;

a disc secured to the shaft within the housing for rotation with the shaft;

a plurality of brush means for engaging the threads on the end of the tubular member, the brush means being adjustably mounted on the disc for rotation with the disc;

a rigid guide means projecting from the disc for receiving the threaded end of the tubular member and for guiding such threaded end of the tubular member into position and for supporting such threaded end of the tubular member while the threads of the tubular member are cleaned; and means connected to the housing for movably supporting the housing in an elevated position.

3. An apparatus for cleaning the threads on the pin end of a tubular member, such as a section of drill pipe, or the like, comprising:

a housing having an opening therein for receiving the threaded pin end of the tubular members;

a disc rotatably supported in said housing;

brush means for engaging the threaded pin end of the tubular member, said brush means being mounted on the disk for rotation therewith;

rigid guide means projecting from the disc for receiving the pin end of a tubular member and for guiding such pin end of the tubular member into position and for supporting said pin end of the tubular member while the threads of the tubular member are cleaned;

means for rotating the disc and the brushes mounted thereon for cleaning the threaded pin end of the tubular member within the housing; and means connected to the housing for movably supporting the housing in an elevated position.

4. An apparatus for receiving the threaded pin end of a heavy tubular member and for cleaning such threads, including:

a housing;

a cover for said housing and having an opening therein for receiving the threaded pin end of the tubular member therethrough whereby the threaded pin end of the tubular member may be cleaned within the housing;

means connected to the housing for movably supporting the housing in an elevated position;

brush means for engaging the threaded pipe end;

a disc mounted for rotation within the housing;

adjustable means mounting the brush means onto the disc;

a rigid member projecting from the disk for engaging within the pin end of the tubular member to support such end of the tubular member while the threads on such tubular member are cleaned;

means for rotating the disc and brushes mounted thereon whereby the brush means cleans the threads on the pin end of the tubular member;

a source cleaning solvent; and means for conducting the cleaning solvent from the source into the housing whereby the threaded pin end of the tubular member is emersed in solvent while the disc and the brushes are rotated.

* * * * *